US006074281A

United States Patent [19]

Swanson et al.

[11] Patent Number: 6,074,281

[45] Date of Patent: Jun. 13, 2000

[54] FINING AND POLISHING MACHINE AND METHOD FOR OPHTHALMIC LENSES

[75] Inventors: S. Keith Swanson; John R. Keller, both of Santa Barbara, Calif.

[73] Assignee: Dac Vision, Inc., Carpinteria, Calif.

[21] Appl. No.: 09/200,626

[22] Filed: Nov. 30, 1998

[51] Int. Cl.[7] ..... B24B 1/00

[52] U.S. Cl. ..... 451/42; 451/5; 451/166; 451/170

[58] Field of Search ..... 451/5, 10, 11, 451/41, 42, 57, 65, 162, 164, 166, 170, 173, 392, 395

[56] References Cited

U.S. PATENT DOCUMENTS

| | | | |
|---|---|---|---|
| 4,571,890 | 2/1986 | Dosaka | 51/92 ND |
| 4,607,460 | 8/1986 | Mushardt | 51/185 TP |
| 5,679,054 | 10/1997 | Chun et al. | 451/9 |
| 5,688,084 | 11/1997 | Fritz et al. | 409/202 |
| 5,957,637 | 9/1999 | Savoie | 409/132 |

*Primary Examiner*—Timothy V. Eley
*Assistant Examiner*—Dung Van Nguyen
*Attorney, Agent, or Firm*—Koppel & Jacobs

[57] ABSTRACT

A fining and polishing machine and method enable a work piece, suitably a spectacle lens, to be polished with a relative motion between the lens and a tool that is precisely matched to the specific lens prescription. The lens and tool are reciprocated along first and second non-co-linear axes, respectively, and the lens is polished as each reciprocates. The relative motion between lens and tool is equal to the vector sum of their individual motions. By precisely controlling the reciprocation of lens and tool, a wide range of desired motions can be obtained, enabling a lens to be polished to a particular prescription by altering the frequency and/or amplitude of the reciprocating motions along the two axes. A controller drives a pair of actuators which reciprocate the lens and tool in accordance with resident motion equations, as realized with prescription-specific amplitude and frequency parameters received as inputs.

36 Claims, 4 Drawing Sheets

FINING AND POLISHING MACHINE AND METHOD FOR OPHTHALMIC LENSES

BACKGROUND OF THE INVENTION

1. Field of the Invention

This invention relates to the field of ophthalmic lens polishing, and particularly to machines and methods for fining and polishing spectacle lenses.

2. Description of the Related Art

Lenses for certain types of eyeglasses are manufactured using a lens blank which is cast with a completed front curvature, but an unfinished back surface. The front surface is blocked to a metal mandrel using, for example, a low temperature metal alloy or a layer of wax. The blocked lens is typically placed in a lathe which machines a prescription on the back surface of the lens, producing a surface that is either spheric or toric (rotationally non-symmetric) in shape. The lathe invariably leaves machining marks on the back surface that must be removed, either by fining (sanding), and/or by polishing to produce an acceptable surface.

Industry practice is to fine and polish the cut lens with a hard lap that has been pre-machined with major and minor axes of curvature that closely match the lens' prescription; abrasive and soft pads are affixed to the lap to respectively fine and polish the machined lens surface. The lap and lens are placed in a "cylinder machine" with their major and minor axes precisely aligned with each other. A cylinder machine typically sweeps the lens back and forth along its major axis, while oscillating the lap in a complex orbital motion. The lap's pad is rubbed against the back surface of the lens to remove the machining marks, thereby smoothing or polishing the back surface.

To obtain maximum fining and polishing effect, the lap's relative travel along the major axis should be at a maximum as long as the surfaces of the lens and the lap pad remain in constant contact with sufficient force to effect the intended polishing. The ideal range of motion will be different for each prescription.

Cylinder machines typically use electric motors. The rotary motion of a motor is translated to motion along the major and minor axes of the lens through geared transmissions and/or belt drives, together with a variety of mechanical linkages. As a result, changing the motion of traditional cylinder machines requires time consuming, complex mechanical adjustments and calibration. To avoid having to make these adjustments for each lens, a nominal motion is selected to accommodate a wide range of prescriptions. However, the use of a nominal motion gives rise to both inefficient fining and polishing, occasional marring of the lens surface, and in many cases, errors between the final lens prescription and the original prescription written by the patient's doctor. These errors must either be accepted by the laboratory and the patient, or the lens must be scrapped.

A cylinder machine's nominal motion can also be excessive for a given lens—causing the lens/pad interface to separate in some areas and mar the lens surface or cause other unacceptable artifacts, and insufficient for other lenses—which gives rise to unacceptably long processing times, or, in extreme cases, insufficient fining and/or polishing to produce a satisfactory lens. Also, although these motion conversion mechanisms are designed to be as random as possible within the prescribed spherical and cylindrical prescription, certain repetitions are inevitable which can give rise to patterns on the lenses which are cosmetically unacceptable to the patient.

SUMMARY OF THE INVENTION

A fining and polishing machine and method are presented that overcome the problems noted above. The invention enables a work piece, suitably a spectacle lens, to be polished with a relative motion between lens and lap that is precisely matched to the specific lens prescription, with different prescriptions easily accommodated without mechanical adjustment.

A spectacle lens is reciprocated along a first axis, and a polishing (or fining) tool is reciprocated along a second axis. The lens and the tool are arranged so that the tool is in contact with the back surface of the lens, so that the lens is polished by the tool as each reciprocates. The relative motion between the lens and the tool (referred to herein as simply "the relative motion") is equal to the vector sum of their individual motions. Thus, by precisely controlling the reciprocation of both lens and tool, a wide range of desired relative motions can be obtained. This enables a lens to be polished to a particular prescription by simply altering the frequency and/or amplitude of the reciprocating motions along the two axes.

In the preferred embodiment, first and second linear actuators reciprocate the work piece and polishing tool, respectively, along orthogonal axes. Equations of motion which define the motions of work piece and tool are stored in a controller. The equations typically have associated amplitude and frequency parameters, which must be provided to fully realize the equations. The controller determines the values of these parameters based on information it is provided about a lens to be polished—such as its prescription, size and material—and then drives the actuators in accordance with the fully realized equations. A different prescription is accommodated by providing different lens information to the controller, which changes the relative motion. This arrangement, in which no mechanical adjustments are necessary to change the relative motion for different prescriptions, enables a lens to be polished more precisely and in less time than was previously possible.

Further features and advantages of the invention will be apparent to those skilled in the art from the following detailed description, taken together with the accompanying drawings.

DETAILED DESCRIPTION OF THE INVENTION

Figure 1:
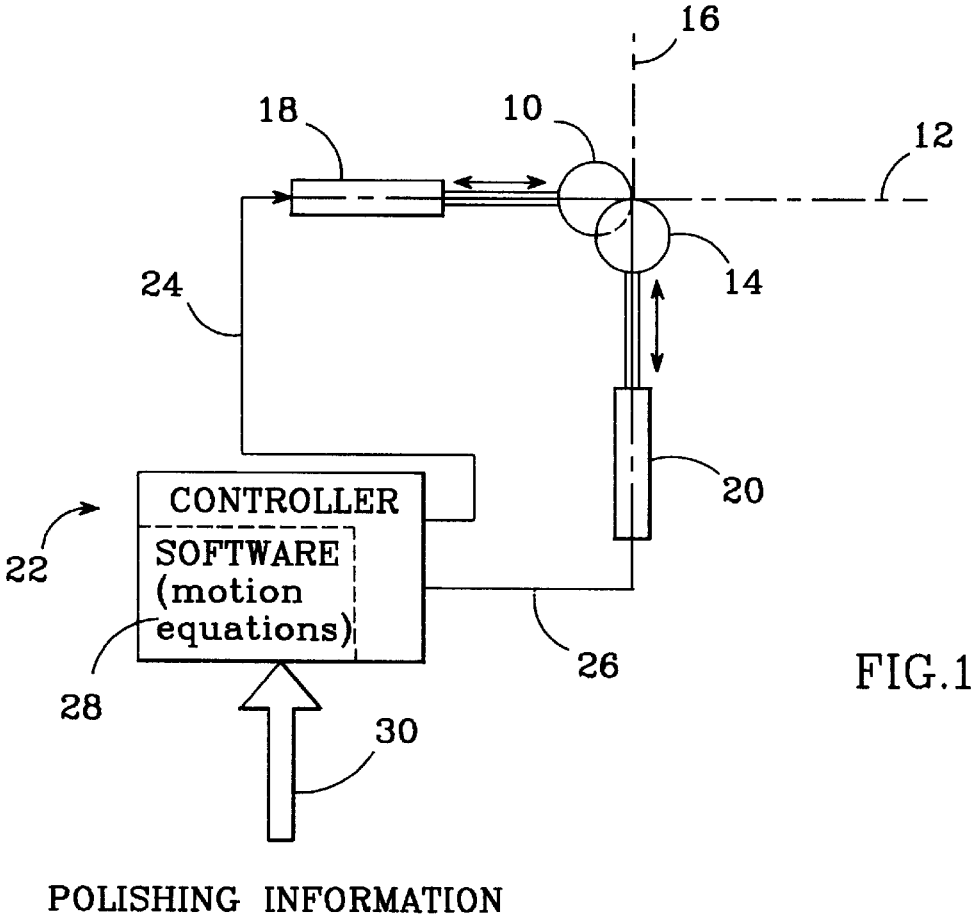
FIG. 1 is a block diagram of a fining and polishing machine per the present invention.

The basic principles of a fining and polishing machine per the present invention are shown in FIG. 1. A work piece 10 is reciprocated along a first axis 12, and a polishing tool 14 is reciprocated along a second axis 16. The work piece and polishing tool are arranged such that, while reciprocating, they are in contact with each other so that the polishing tool polishes the surface of the work piece.

A work piece to be polished is suitably a spectacle lens, though the invention could be adapted to polish the surfaces of other items as well. The type of polishing tool to be used is dependent on the type of work piece being polished; for a spectacle lens, a hard lap having a pad of a particular grit affixed to the lap surface that contacts the lens is preferred. The pad can be either abrasive or soft, to fine or polish the lens, respectively, as needed. Though the invention is not limited to spectacle lens work pieces and hard lap polishing tools, these are used herein to illustrate the invention and its operation.

The present invention is equally suited to either fining or polishing. As used herein, the term "polishing tool" refers to any type of tool which can effect the polishing or fining of a work piece—including a hard lap having either an abrasive or soft pad affixed to its surface as needed. A pad typically has an adhesive backing which adheres it to the lap. Similarly, "polishing the lens" as used herein encompasses both fining and polishing, as needed.

When work piece 10 is a spectacle lens, its front surface is attached to a holding fixture, and its back surface is presented to the polishing tool 14. The lens 10 and the tool 14 are preferably reciprocated with respective actuators 18 and 20. The distance that each travels, and the frequency of reciprocation are determined by a controller 22 which controls the motions of the two actuators. The relative motion between the lens and the tool is the vector sum of their individual motions. Thus, a wide range of possible relative motions can be obtained by varying the amplitude and frequency of each actuator; this enables the invention to provide many different relative motions, including some which are nearly optimum for respective prescriptions. An "optimum" relative motion as used herein is one which produces a uniform removal of material over as much of the lens surface as possible, and which avoids the removal of excess material. For example, an optimum motion for a lens having significantly different major and minor meridians might be an elliptical relative motion which compensates for the differences; by commanding actuators 18 and 20 to move in a prescribed manner, the invention easily produces the desired optimum motion.

The first and second axes 12 and 16 are depicted in FIG. 1 as linear and orthogonal. As noted above, the relative motion between the lens and the tool is the vector sum of their individual motions, and motion equations for the work piece and tool can be defined which produce a desired relative motion. Making the first and second axes linear and orthogonal reduces the complexity of the equations, and for this reason linear and orthogonal axes are preferred; note, however, that the invention is not limited to axes that are orthogonal or linear.

Several examples of motion equations are given below, along with plots of the relative motions produced by each. Note that these examples are purely illustrative, and that there is virtually no limit to the complexity of the motion that the invention can produce.

Figure 2A:
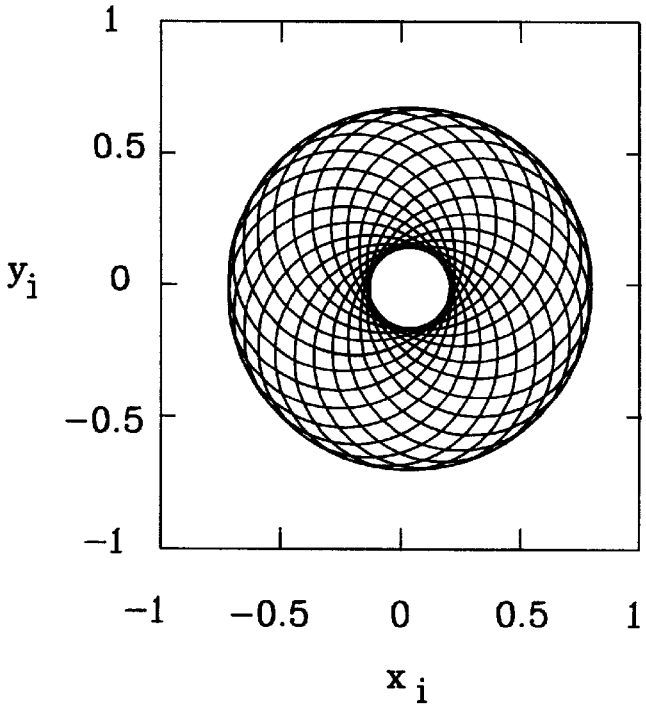
FIGS. 2*a*, 2*b* and 2*c* are exemplary plots of relative motions attainable with a fining and polishing machine per the present invention.

FIG. 2*a* is a plot of one type of relative motion achievable by the invention, showing a symmetrical sum of the motions of linear actuators aligned along orthogonal x and y axes. The motion along the x axis is defined using the sine function, with y-axis motion shifted by 90 degrees by using the cosine function instead of the sine. The equations describing the motion in the x direction ($x_i$) and in the y direction ($y_i$) are as follows:

$$x_i=(Ap/2)*\sin[2\pi*Fp*(i/1000)]+(Am/2)*\sin[2\pi*Fm*(i/1000)]$$

$$y_i=(Ap/2)*\cos[2\pi*Fp*(i/1000)]+(Am/2)*\cos[2\pi*Fm*(i/1000)]$$

where Ap and Fp are the amplitude and frequency, respectively, of the motion along the "primary" axis, and Am and Fm are the amplitude and frequency, respectively, of the motion along the "minor" axis. On a spectacle lens, the primary axis is the axis of rotation of the cylinder cross curve, identified as $x_i$ in FIG. 2, and the minor axis is the axis of rotation of the spherical base curve, identified as $y_i$ in FIG. 2.

In FIG. 2*a*, Ap and Am are equal, as are Fp and Fm. This produces a repetitive pattern, so that any piece of grit or other matter in the polishing compound would probably result in an artifact on the lens surface, possibly rendering it unacceptable.

Figure 2B:
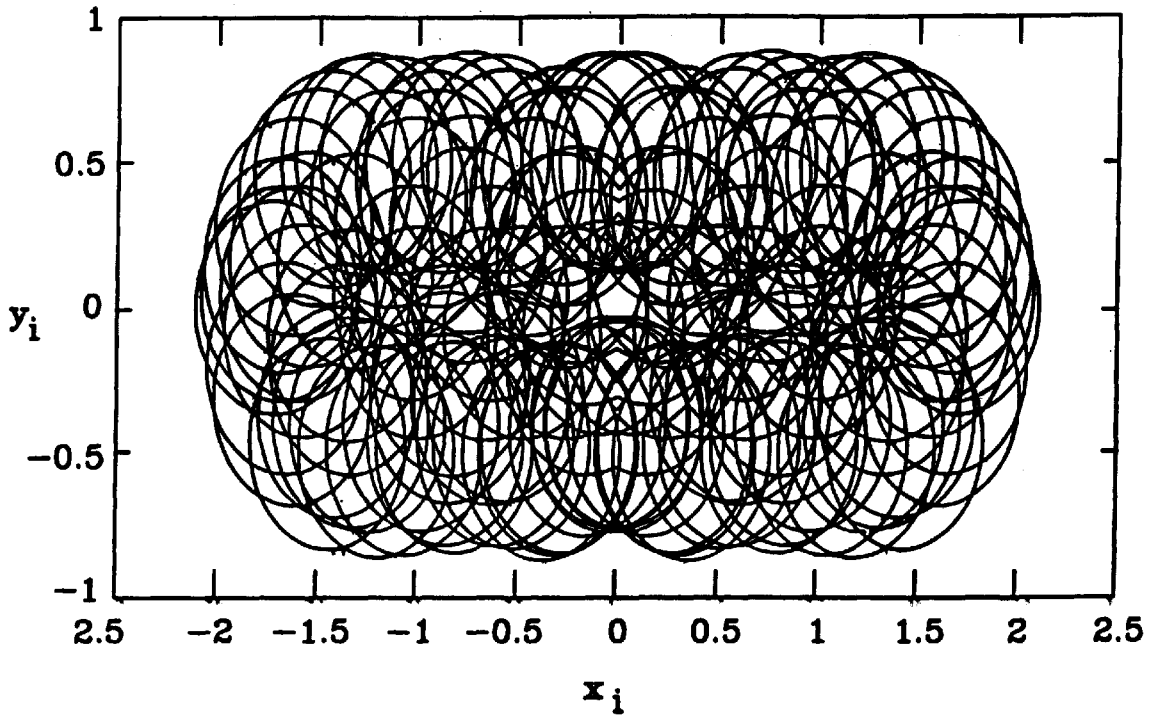
Figure 2C:
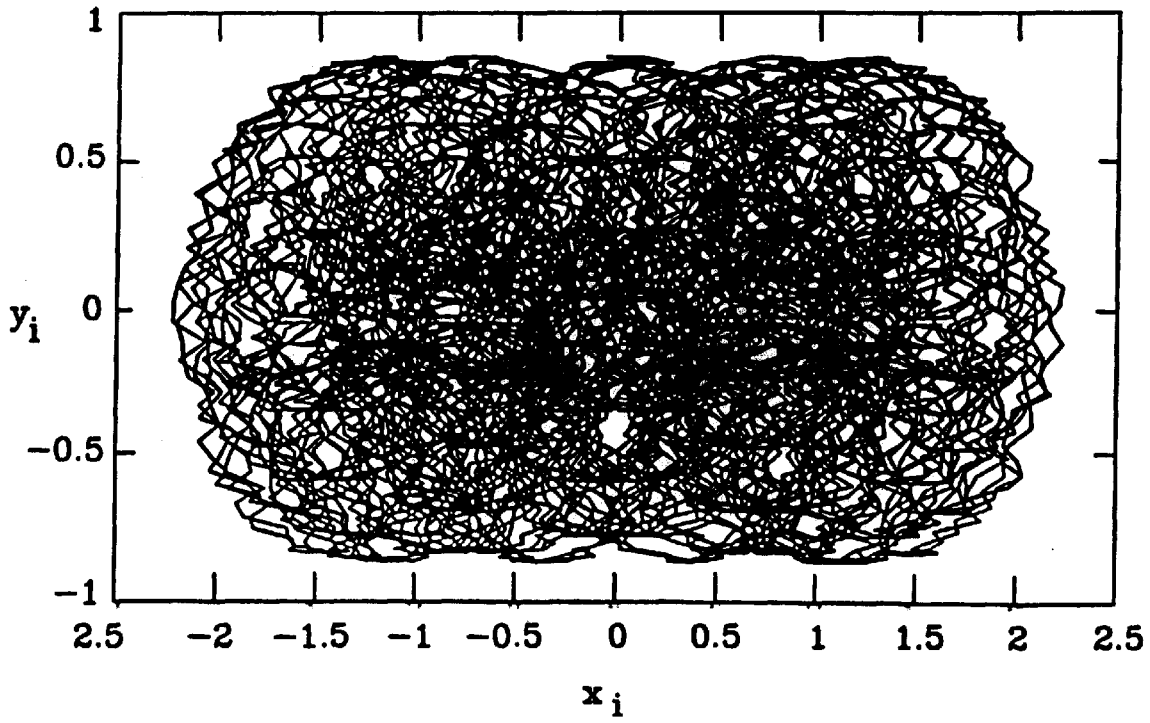

Another factor is likely to render the relative motion shown in FIG. 2*a* inadequate: most spectacle lenses are ground with a "spherical" cut, and a second "cylinder" cut which is transverse to the spherical cut. Polishing such a lens requires motion in the "long" direction, along the major axis formed by the cylinder cut, and in the "short" direction, along the minor axis transverse to the cylinder cut. This type of relative motion is illustrated in FIG. 2*b*. For simple harmonic motion in both the x and y axes, motion along the x direction ($x_i$) and the y direction ($y_i$) is given by:

$$x_i=(Ap/2)*\sin[2\pi*Fp*(i/500)]+(Am/2)*\sin[2\pi*Fm*(i/500)]+(As/2)*\sin[2\pi*Fs*(i/500)]$$

$$y_i=(Ap/2)*\cos[2\pi*Fp*(i/500)]+(Am/2)*\cos[2\pi*Fm*(i/500)]$$

where As and Fs are the amplitude and frequency, respectively, of the motion along the long or "swept" axis, shown as the extremes of motion along the x axis in FIGS. 2*b* and 2*c*. These equations form a bilaterally symmetrical pattern similar to that provided by motor-driven cylinder machines in which an orbital pattern is swept back and forth along the major axis, and oscillated along the minor axis. It can be seen that the pattern repeats, again giving rise to the possibility of leaving an artifact on the lens surface.

The possibility of leaving an artifact on the lens surface can be virtually eliminated by adding a small random motion factor to one of the motion equations. This is illustrated in the plot shown in FIG. 2*c*, for which motion in the x direction ($x_i$) and in the y direction ($y_i$) is given by:

$$x_i=(Ap/2)*\sin[2\pi*Fp*(i/500)]+(Am/2)*\sin[2\pi*Fm*(i/500)]+(As/2)*\sin[2\pi*Fs*(i/500)]+(0.5-rnd(1))*Ar$$

$$y_i=(Ap/2)*\cos[2\pi*Fp*(i/500)]+(Am/2)*\cos[2\pi*Fm*(i/500)]$$

where rnd(1) is a random number, preferably computer-generated, between zero and unity and Ar is an amplitude scaling constant. In this example, the random component is a maximum of 5% of the total x amplitude. As can be seen from FIG. 2*c*, the use of a random factor in this way nearly eliminates any repetition in the relative motion, making it very unlikely that artifacts will be left on the lens as a result of the polishing operation.

The equations of motion used to define the motions of the two linear actuators 18 and 20 are preferably determined empirically: relative motions that provide short processing time, uniform material removal over as much of the lens as possible, and high prescription-matching quality are identified, and motion equations that produce the desired relative motions are derived. Controller 22 is preferably a programmable device driven by resident software 28, and the identified motion equations are either placed on a storage device and retrieved by the software when needed, or are embedded within the software. Whether stored or embedded, these equations are referred to herein as the "resident motion equations".

The resident motion equations typically include amplitude and frequency terms (such as the Ap, Am, As, Ar, Fp, Fm, and Fs terms found in the equations above), which must take on numerical values if the equations are to be fully realized. The controller is preferably arranged to receive inputs 30 that provide information about the work piece to be polished, such as its prescription, size, and material in the case of a spectacle lens. Resident software 28 receives this information and produces the amplitude and frequency parameter values needed to fully realize the resident motion equations. To perform the polishing operation, the controller 22 produces control outputs 24 and 26 to actuators 18 and 20, respectively, to move the work piece and tool in accordance with the fully-realized resident motion equations and thereby produce a desired relative motion.

A software-driven controller is preferred, as this enables the invention to polish lenses to a wide range of prescriptions by simply providing different inputs to the controller; i.e., no mechanical adjustments of any sort are required to accommodate different prescriptions. A controller which is not software-driven could also be used, but the ease and convenience provided by a software-driven device are likely to be sacrificed. However, to insure that the beneficial accommodating of different prescriptions without need of mechanical adjustment is realized, it is essential that the controller 22 be able to produce outputs that control the reciprocation of a work piece and a polishing tool, and that those outputs be easily varied to provide different relative motions as needed.

A given set of motion equations resident in controller 22 is likely to be able to accommodate a wide range of prescriptions when provided with appropriate amplitude and frequency parameters values. The invention is not limited to any particular set of motion equations, nor is it essential that it utilize only one set of equations. The forms of the resident motion equations are dictated by the specific application for which the invention is to be used, and may be much different than those shown in the examples above. If needed, controller 22 can be arranged to produce control outputs in accordance with one of a number of equation sets; if controller 22 is programmable, each set of equations should be made resident, and a means provided whereby the set needed for a particular application can be easily selected.

Figure 3:
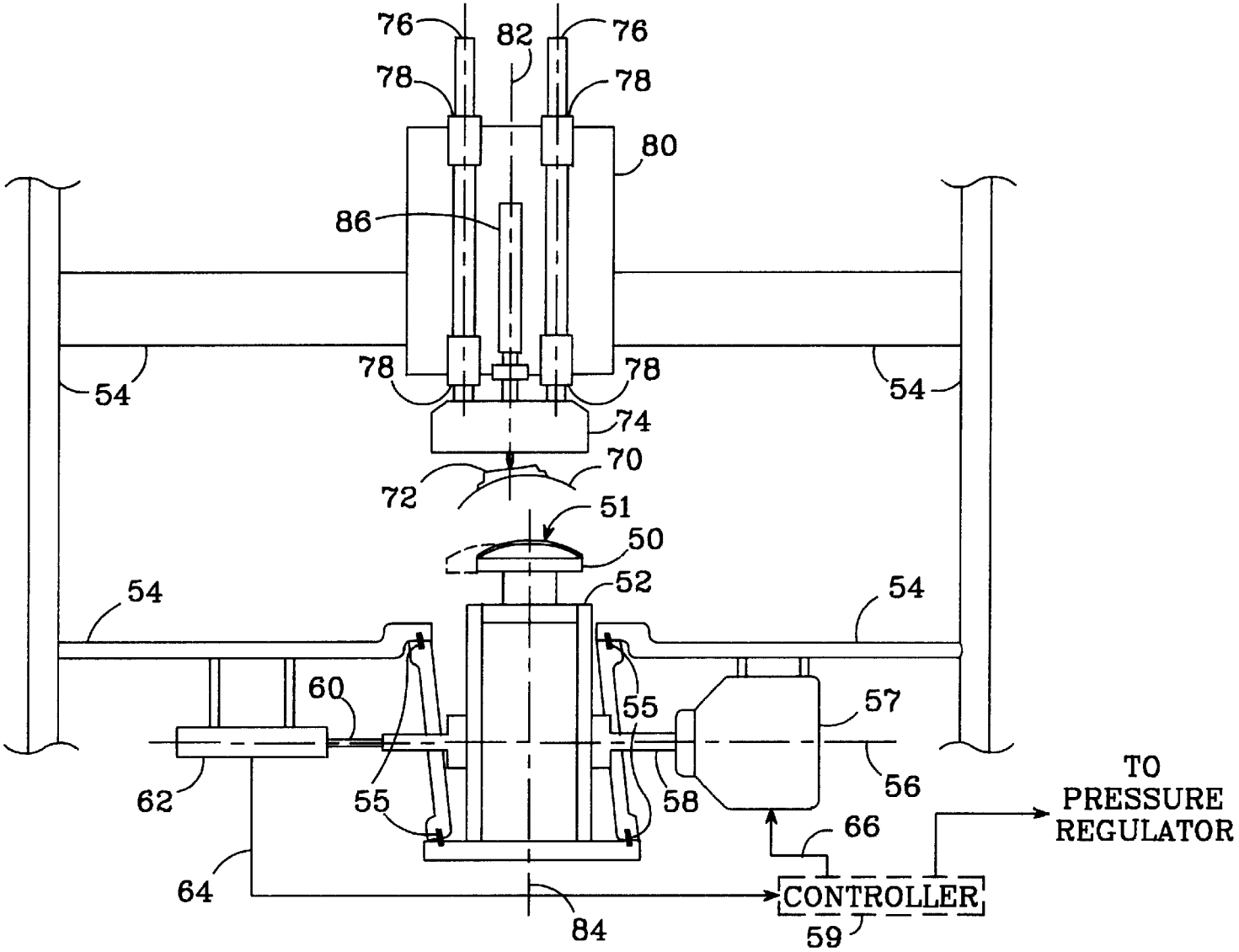
FIG. 3 is a top plan view of a fining and polishing machine per the present invention.

A top plan view of a preferred embodiment of the present invention is shown in FIG. 3. A polishing tool 50, preferably a hard lap with an abrasive or soft pad 51 affixed to its surface, is secured to a fixture 52. Fixture 52 is attached to a fixed structure 54 with a pair of flexures 55 that allow it to move back and forth along a first axis 56. A linear actuator 57 is also mounted to structure 54; actuator 57 has an armature 58 which is attached to fixture 52. Actuator 57 reciprocates armature 58 in response to a control signal received from a controller 59; as armature 58 reciprocates, fixture 52 and tool 50 are moved back and forth along axis 56.

To enable the fining or polishing machine to provide a predetermined relative motion, the motion of tool 50 must be precisely controlled. This is preferably accomplished with a closed-loop feedback system. To sense the position of tool 50, a tool positioning rod 60 is attached to fixture 52 and extends into a tool position sensing device 62 such as a linear variable differential transformer (LVDT) type sensor. Sensing device 62 produces an output signal 64 which varies with the position of tool 50 and is fed to controller 59. As discussed above, controller 59 preferably has empirically-determined motion equations resident within it; lens information is provided to the controller, which in turn calculates the amplitude and frequency parameter values needed to fully realize the resident equations. Controller 59 provides closed-loop control of tool position by comparing the current position of tool 50 with the position required by the motion equations to produce an error signal, and outputting a control signal 66 to linear actuator 57 to move tool 50 as needed to drive the error signal to zero. In this way, tool 50 is made to move in accordance with the fully-realized resident motion equations.

Actuator 57, tool positioning rod 60 and sensing device 62 are all preferably aligned along axis 56, with actuator 57 and sensing device 62 preferably held in place via rigid attachment to structure 54.

A lens to be polished 70 is mounted to a mandrel 72, which is in turn attached to a fixture 74. Fixture 74 is affixed to a pair of slides 76, which pass through supports 78 affixed to a fixture 80 secured to structure 54. Slides 76 allow lens 70 to move back and forth along an axis 82, which is preferably parallel to an axis 84 running through the center of tool 50 and fixture 52. Slides 76 are positioned to allow lens 70 to be brought into contact with tool 50 when a polishing operation is to be performed, and to be moved away from tool 50 when polishing is complete.

Lens 70 and fixture 74 are preferably moved back and forth along slides 76 with a pneumatic cylinder assembly 86. Pressure to pneumatic cylinder 86 is preferably controlled by controller 59 via a pressure regulator (not shown), which maintains a predetermined force between tool 50 and lens 70 to properly effect fining or polishing.

Figure 4:
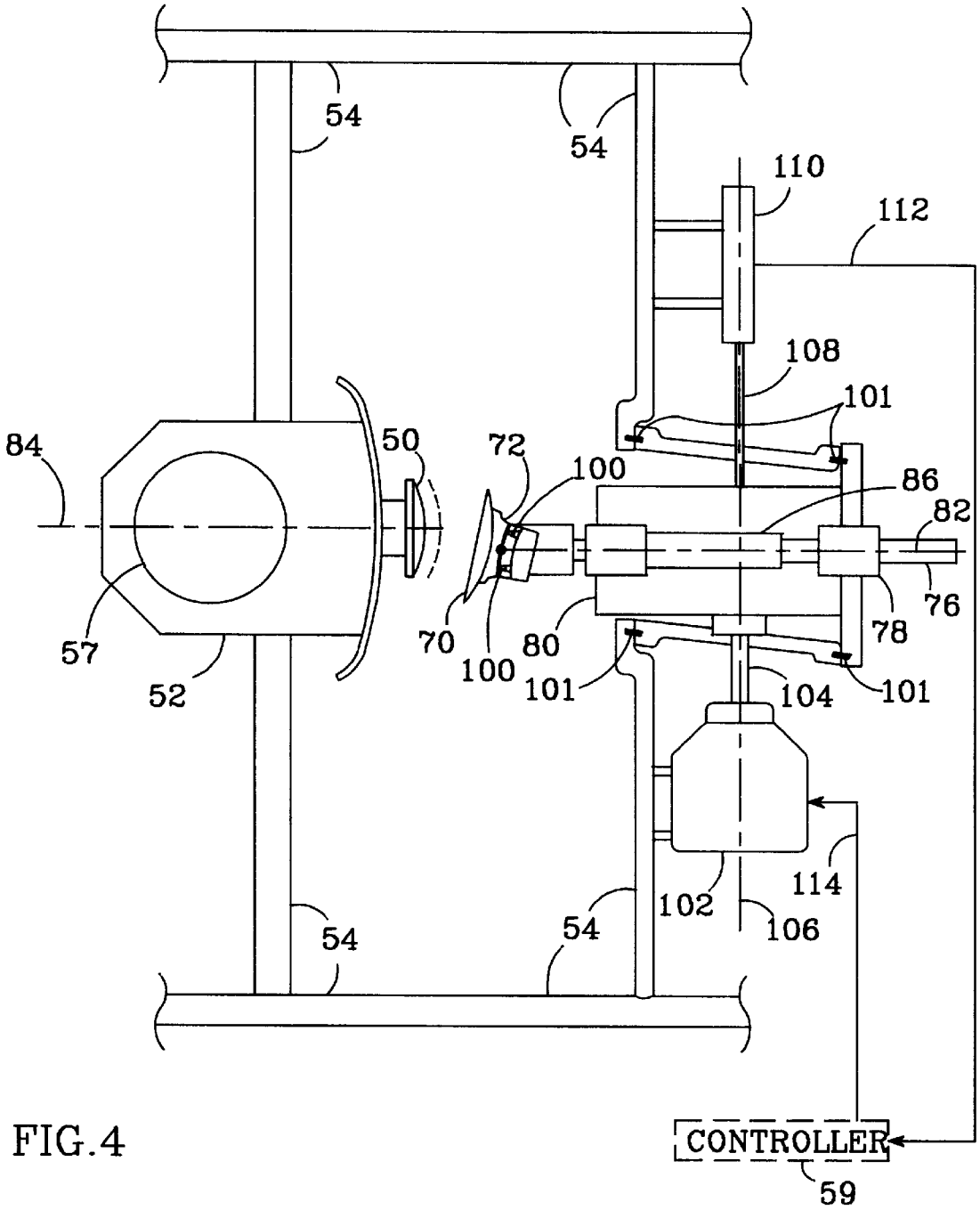
FIG. 4 is a side elevation view of the fining and polishing machine shown in FIG. 3.

FIG. 4 is a side elevation view of the fining and polishing machine shown in FIG. 3, with features seen in both views commonly labeled. Note that for clarity, not all features are shown in both FIGS. 3 and 4. A pair of mandrel pins 100 engage holes on the back of lens mandrel 72 to maintain the orientation of the lens' major and minor axes with respect to tool 50. Fixture 80 is mounted to structure 54 using a pair of flexures 101, in the same manner as fixture 52. A linear actuator 102 having an armature 104 is attached to fixture 80; when activated, actuator 102 moves fixture 80 and thereby lens 70 back and forth along an axis 106. The axis 106 along which the lens is reciprocated is preferably orthogonal to the axis 56 along which the tool is reciprocated.

A lens positioning rod 108 is attached to fixture 80 and extends into a lens position sensing device 110. Actuator 102, positioning rod 108 and sensing device 110 are all preferably aligned along axis 106. The reciprocation of lens 70 is controlled in the same manner as tool 50. Position sensing device 110 outputs a position signal 112 to controller 59, which outputs a control signal 114 to linear actuator 102 to cause lens 70 to be moved in accordance with the resident motion equations. Thus, controller 59 controls the reciprocation of linear actuators 57 and 102 in accordance with its resident motion equations—their amplitude and frequency parameter values having been ascertained based on the inputted lens information—to produce nearly optimum relative motion between lens and tool, fining or polishing the lens to a given prescription with an efficiency and accuracy that has been previously unattainable.

The force between lens 70 and tool 50 during a polishing operation is preferably maintained constant for every point on the lens surface. The surface being polished is curved, requiring lens 70 to move along axis 82 during polishing to maintain contact with tool 50; because of the curved surface, a variable pneumatic pressure is needed to maintain a constant force across the lens. This is preferably accomplished with a closed-loop feedback system which controls the pneumatic pressure that brings the lens and tool into contact with each other.

Linear actuators 57 and 102 are preferably voice coils. Voice coil actuators have been used to provide motion in accordance with resident motion equations while reciprocating at a rate of about 20 Hz.

The use of a coolant fluid during polishing is recommended. The lens 70 being polished should be subjected to a flow of a coolant, preferably an aluminum oxide slurry, to prevent its becoming overheated and thereby damaged.

The controller 59 is preferably a microprocessor-based device, which is programmed to receive inputs that provide information about the particular lens to be polished, generate the amplitude and frequency parameter values needed to fully realize its resident equations, and of generating the control signals needed to move the lens and tool in accordance with the equations. Lens information can be inputted by a number of means, such as a keyboard, electronic data link, or bar code scanner, for example.

While particular embodiments of the invention have been shown and described, numerous variations and alternate embodiments will occur to those skilled in the art. Accordingly, it is intended that the invention be limited only in terms of the appended claims.

We claim:

1. A method of polishing or fining a work piece, comprising the steps of:

bringing a tool into contact with a work piece to be polished or fined, reciprocating said work piece along a first axis while maintaining contact with said tool, and reciprocating said tool along a second axis that is not co-linear to said first axis while maintaining contact with said work piece whereby the relative motion between said work piece and said tool is the vector sum of their respective motions, said contact between said work piece and said tool while each is reciprocating polishing said work piece.

2. The method of claim 1, wherein said second axis is orthogonal to said first axis.

3. The method of claim 1, further comprising the steps of defining equations to describe the motions of said workpiece and said tool which will polish or fine said work piece in a desired manner, and reciprocating said work piece and said tool in accordance with said equations.

4. The method of claim 3, wherein said equations have associated amplitude and frequency parameters, said method further comprising the step of providing values for said amplitude and frequency parameters to enable said work piece to be polished or fined in said desired manner.

5. The method of claim 1, wherein said work piece and said tool are reciprocated with respective linear actuators.

6. The method of claim 1, wherein said tool is brought into contact with said work piece with a pneumatic cylinder assembly.

7. The method of claim 1, wherein said work piece is a spectacle lens and said tool is a lap having a pad of a particular grit affixed to it which contacts said lens.

8. A method of fining or polishing a spectacle lens, comprising the steps of:

bringing a tool into contact with a surface of a spectacle lens to be polished, reciprocating said spectacle lens along a first axis in accordance with a first predetermined equation of motion having associated amplitude and frequency parameters, reciprocating said tool along a second axis orthogonal to said first axis in accordance with a second predetermined equation of motion having associated amplitude and frequency parameters whereby the relative motion of said lens to said tool is the vector sum of their respective linear motions, said relative motion polishing said surface of said lens contacted by said tool.

9. The method of claim 8, wherein said first and second axes are linear axes.

10. The method of claim 8, wherein said tool is a lap having a pad of a particular grit affixed to it.

11. The method of claim 10, wherein said pad is an abrasive pad which fines said spectacle lens.

12. The method of claim 10, wherein said pad is a soft pad which polishes said spectacle lens.

13. The method of claim 8, further comprising the step of providing values for said amplitude and frequency parameters to produce a desired relative motion between said lens and said tool.

14. The method of claim 8, wherein said relative motion between said lens and said tool polishes or fines said lens to a particular prescription, said method further comprising the step of providing said values for said amplitude and frequency parameters to achieve a desired prescription.

15. A machine for fining or polishing a work piece, comprising:

a first actuator which reciprocates a work piece along a first axis, a second actuator which reciprocates a tool along a second axis that is not co-linear with said first axis, said first and said second actuators arranged such that said tool contacts said work piece when said actuators are reciprocating whereby the relative motion of said work piece to said tool is the vector sum of the motions of their respective actuators, and a controller arranged to control the motion of said first and said second actuators to fine or polish said work piece.

16. The machine of claim 15, wherein said actuators are linear actuators.

17. The machine of claim 15, wherein said first axis and said second axis are orthogonal to each other.

18. The machine of claim 15, wherein said work piece is a spectacle lens and said tool is a lap having a pad of a particular grit affixed to it which contacts said lens.

19. The machine of claim 18, wherein said pad is an abrasive pad which fines said lens.

20. The machine of claim 18, wherein said pad is a soft pad which polishes said lens.

21. The machine of claim 15, wherein said controller receives one or more inputs that describe a particular work piece and is arranged to control the motion of said first and second actuators to polish said work piece based on said inputs.

22. The machine of claim 21, wherein said controller is arranged to move each of said actuators in accordance with respective predetermined equations of motion which each have associated amplitude and frequency parameters, the values of said parameters ascertained from said inputs, each of said equations describing the motion of its respective actuator.

23. The machine of claim 22, wherein said equations of motion are determined empirically to provide nearly uniform removal of material from said work piece over nearly all of the surface of said work piece that is in contact with said tool.

24. The machine of claim 21, wherein said work piece is a spectacle lens and said inputs represent information about said lens.

25. The machine of claim 24, wherein said information comprises said lens' prescription, size and material, said controller arranged to polish said lens to the specified prescription.

26. The machine of claim 15, further comprising a third actuator arranged to press said work piece and said tool together.

27. The machine of claim 26, wherein said third actuator is arranged to maintain a nearly constant predetermined force between said work piece and said tool while said work piece and said tool are in contact with each other and being reciprocated.

28. A machine for fining or polishing a spectacle lens, comprising:

a first actuator which reciprocates an affixed spectacle lens along a first axis in accordance with a first control signal from a controller, a second actuator which reciprocates a polishing tool along a second axis orthogonal to said first axis in accordance with a second control signal from said controller, said first and second actuators arranged such that said polishing tool contacts a surface of said lens when said actuators are reciprocating whereby the relative motion of the lens to the polishing tool is the vector sum of the motions of their respective actuators, and a controller which receives one or more inputs that represent information about said lens, at least one of said inputs representing a desired prescription for said lens, said controller arranged to generate said first and said second control signals based on said inputs representing said desired prescription to fine or polish said lens to said desired prescription.

29. The machine of claim 28, wherein said controller is arranged to move each of said actuators in accordance with respective predetermined equations of motion, each of which has associated amplitude and frequency parameter values which are determined based on said inputs that represent information about said lens, each of said equations describing the motion of its respective actuator.

30. The machine of claim 29, wherein at least one of said equations of motion includes a random factor which reduces the repetition of the relative motion between the lens and the polishing tool when both are reciprocating and thereby reduces the likelihood of artifacts being left on said surface of said lens contacted by said polishing tool by said polishing.

31. The machine of claim 28, further comprising a third actuator arranged to press said spectacle lens and said polishing tool together.

32. The machine of claim 31, wherein said third actuator is a pneumatic cylinder assembly.

33. The machine of claim 28, wherein said first and said second actuators comprise voice coils.

34. The machine of claim 28, wherein said first and said second actuators are linear actuators.

35. The machine of claim 28, further comprising a source of coolant, said machine arranged to provide coolant to said lens while said lens is being polished.

36. The machine of claim 35, wherein said coolant is an aluminum oxide slurry.

* * * * *